United States Patent [19]

Dudek

[11] Patent Number: 4,473,218

[45] Date of Patent: Sep. 25, 1984

[54] FEEDER TRAY FOR CONTINUOUS FORMS BURSTING

[76] Inventor: Norbert J. Dudek, 1723-25 Fourth St., Peru, Ill. 61354

[21] Appl. No.: 409,640

[22] Filed: Aug. 19, 1982

[51] Int. Cl.[3] ..... B65H 41/00

[52] U.S. Cl. ..... 270/52.5; 225/100

[58] Field of Search ..... 270/52, 52.5; 225/3, 225/93, 100, 106; 226/5, 170–172, 174, 178, 181–183, 188

[56] References Cited

U.S. PATENT DOCUMENTS

| | | | |
|---|---|---|---|
| 2,777,690 | 1/1957 | Davidson | 270/52.5 X |
| 3,794,228 | 2/1974 | Colwill et al. | 225/93 |
| 3,888,399 | 6/1975 | Hanson et al. | 225/106 |
| 3,972,283 | 8/1976 | Jennings | 270/52.5 X |
| 3,987,949 | 10/1976 | Manning et al. | 225/100 X |
| 3,991,924 | 11/1976 | Schueler | 225/100 |
| 4,261,497 | 4/1981 | Roetter et al. | 225/100 |
| 4,306,711 | 12/1981 | Van Malderghem | 270/52.5 |
| 4,341,003 | 7/1982 | Kopena | 225/3 |
| 4,375,189 | 3/1983 | Berner et al. | 225/100 |
| 4,397,410 | 8/1983 | Schueler | 225/100 |

FOREIGN PATENT DOCUMENTS

| | | | |
|---|---|---|---|
| 2135130 | 1/1973 | Fed. Rep. of Germany | 270/52.5 |

*Primary Examiner*—E. H. Eickholt

[57] ABSTRACT

A feeder tray for feeding a continuous form into a friction feed folding machine. A continuous form, which is typically a printout generated by a computer's printer, is pulled through a pair of tensioning rollers mounted on the feeder tray. The continuous form exits the tensioning rollers and is fed between a friction wheel and idler wheel. Upon exiting the friction wheel the form is engaged by a pair of stripper wheels which are rotating at a much higher rate than the friction wheel or tension rollers. The sudden increase in lineal speed imparted to the continuous form by the stripper wheels causes the form to burst at a perforation. The bursting operation is repeated at each perforation to reduce the continuous form to a plurality of singular sheets.

8 Claims, 4 Drawing Figures

FEEDER TRAY FOR CONTINUOUS FORMS BURSTING

The invention relates generally to a feeder tray attachment for mounting on a friction feed folding machine. The feeder tray allows the folding machine to receive a continuous form instead of single forms (or sheets) as is normally the case with folding machines.

Generally speaking, there are a number of continuous forms bursting machines on the market which adequately accomplish the task of bursting a continuous form into singular sheets. Once the continuous forms are burst apart, the single forms are separated and stacked by the bursting machine, and then moved to a folding machine whereupon they are folded and stacked.

The present invention is mounted directly on a folding machine, such as a Baumfolder, manufactured by Baumfolder Corporation, Sidney, Ohio, for the purpose of feeding a continuous form directly to the folding machine, and bursting the same all in one operation. The invention virtually eliminates the need for a separate bursting machine where the single sheets are subsequently folded, as well as saving time by utilizing a single operation mode.

Accordingly, it is an object of the present invention to provide a device which is easily adaptable for mounting on any folding machine by untrained operators.

It is a further object to provide an economical alternative to a separate bursting machine, and in fact, is capable of eliminating the requirement for a separate bursting machine in some applications.

It is also an object to provide a device which is easily adjustable so that it is capable of running various widths and lengths of continuous forms, limited only by the capabilities of the folding machine upon which it is mounted.

An additional object is to provide a device which is able to feed a continuous form at various speeds in synchronization with the timing of the folding machine upon which it is attached.

Finally, it is an object of this invention to provide a device which has relatively few moving parts so that maintenance and down time are kept to a minimum.

Other objects and advantages of the invention will become apparent upon reading the attached detailed description and upon reference to the drawings, in which.

While the invention has been described with certain preferred embodiments, it will be understood that we do not intend to be limited to the embodiments shown, but intend, on the contrary, to cover the various alternative forms of the invention included within the spirit and scope of the appended claims.

Figure 1:
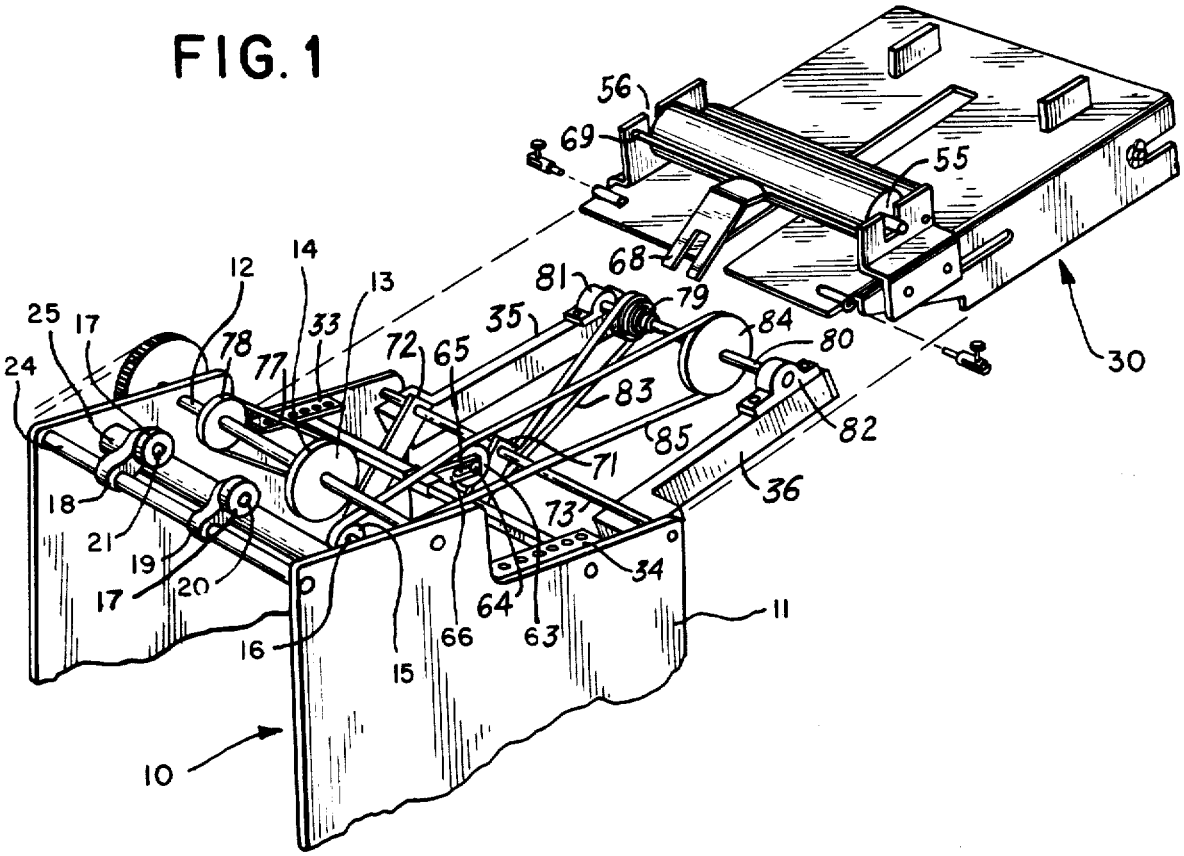
FIG. 1 is a perspective view of the feeder tray and its relationship as it is mounted on the end of a folding machine.

Turning now to FIG. 1 there is shown generally one end of a friction feed folding machine 10. The machine is comprised of a frame 11 which provides support for the main drive shaft 12 and the feeder tray 30. The folding machine is capable of folding a large number of individual sheets or forms. In fact, some friction feed folding machines are capable of running more than 15,000 forms per hour, depending on the length and weight of the forms.

A frictional feed wheel 13 is mounted on the main drive shaft 12 for rotational movement. The wheel 13 is fixed on the drive shaft substantially along the longitudinal axis of the machine 10. The outer surface 14 of the wheel is comprised of a material which has a high coefficient of friction with respect to paper products so that it grips the forms during high speed operation. An idler wheel 15 is mounted on shaft 16 (see FIG. 1) so that the nip formed by the frictional feed wheel 13 and the idler wheel 15 allows a single thickness form to pass through without pinching the form or causing it to wrinkle.

A pair of stripper wheels 17 are mounted separately on brackets 18, 19. Each bracket has a shaft 20, 21 upon which the stripper wheels 17 are free to rotate. Each bracket 18, 19 cooperates with a spring loaded tensioning arms (not shown) which are mounted on a common non-rotating shaft 24. By increasing or decreasing the spring tension force between the tensioning arms and the bracket 18, 19, the nip opening between the stripper wheels 17 and a rotatable drive roller 25 can be adjusted. The drive roller 25 rotates to produce a linear tangential speed of approximately two and one-half times the linear tangential speed of the frictional feed wheel 13. This high rotational speed is imparted to the stripper wheels 17 since they are generally resting or slightly tensioned into contact with the drive roller 25.

As a continuous form 9 is fed from the frictional feed wheel 13, it slides between the stripper wheels 17 and the drive roller 25. The difference in relative linear tangential speeds between the frictional feed wheel 13 and the stripper rollers 17 causes a tensioning in the continuous form to burst the form along its perforations. This will be more fully discussed below.

Figure 2:
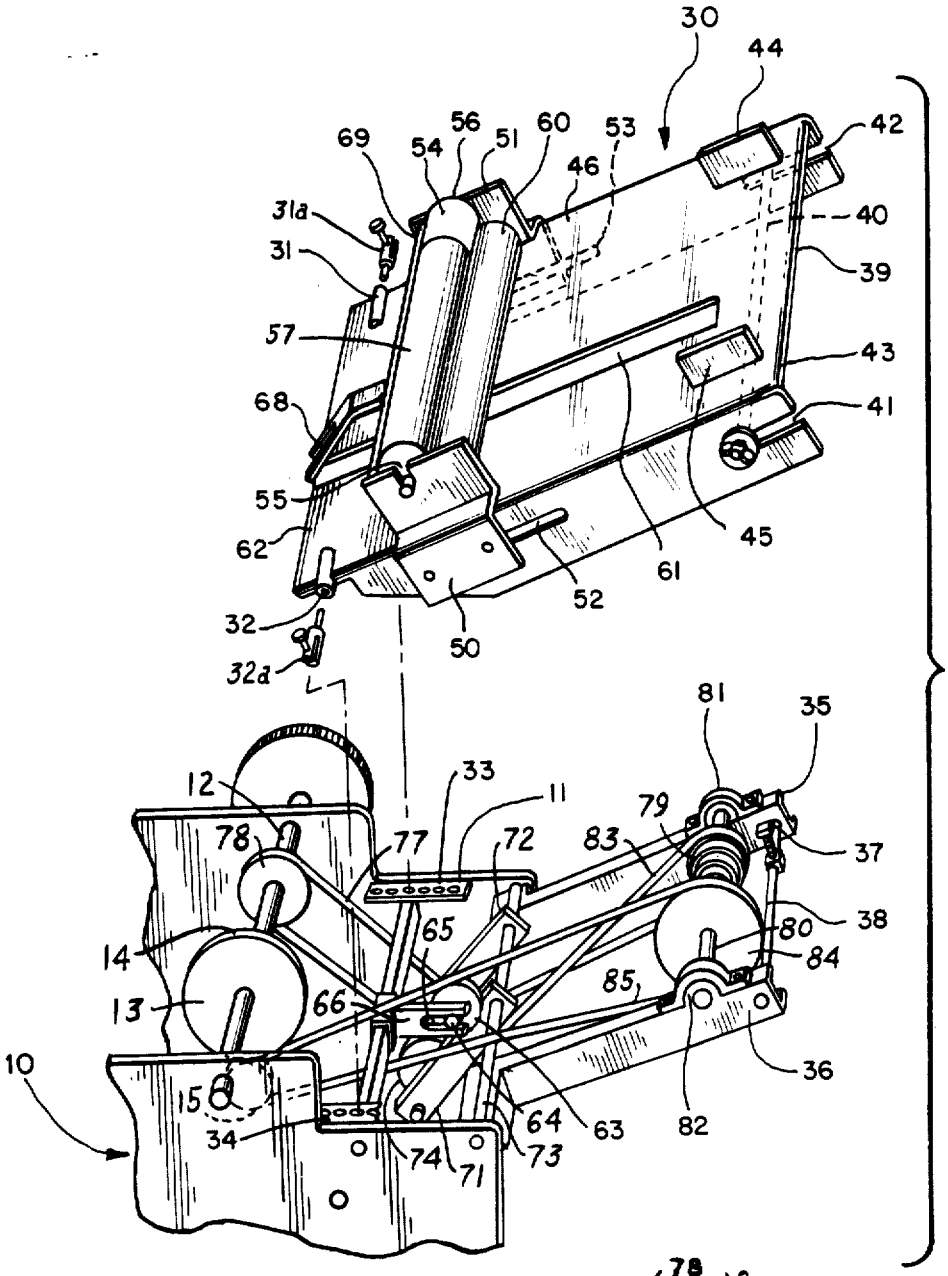
FIG. 2 is an exploded perspective view of the feeder tray and its relationship to the folding machine.

In accordance with the present invention, we turn to FIG. 2, where is shown a feeder tray 30 for mounting on a frictional feed folding machine 10. The feeder tray 30 is mounted to frame 11 in any conventional manner, the preferred embodiment is to provide mounting pins 31*a* and 32*a* which slidably engage flange plates 33 and 34. As shown in exploded form in FIG. 2, the slotted portion of pins 31*a* and 32*a* slide along plates 33 and 34, the thumbscrew on each pin being the means for locking each pin in a particular hole in the plates 33 and 34. Mounting brackets 31 and 32 receive the dowel portion of pins 31*a* and 32*a* making the feeder tray 30 pivotally fastened at brackets 31 and 32 to the flange plates 33 and 34.

Several mounting holes are provided in flange plates 33, 34 so that the distance between the tension rollers 54, 60 on the feeder tray 30 and the stripper rollers 17 can be controlled. It is necessary to vary this distance when changing a bursting run from, for example, 8½ inch length paper to 14 inch length paper. More discussion on the distance adjustment appears below.

The feeder tray 30, being fastened at its one end to the frame 11, is supported by channels 35, 36, at its other end. The support channels 35, 36 are preferably bolted to the frame 11 for ease of assembly/disassembly when necessary. The angular relationship between the support channels 35, 36 and feeder tray 30 is varied by means of elevation screw 37 mounted on spacing bar 38. The feeder tray 30 pivots on its mounting brackets 31, 32 at frame 11 at its one end, and rests on the elevation screw 37 at its other end. By simply turning the elevation screw 37 the angular relationship between the feeder tray 30 and support channels 35, 36 can be controlled. The feeder tray 30 pivots on the pins 31*a*, 32*a* in brackets 31, 32 when elevation screw 37 is turned, providing the desired angular displacement. The necessity for controlling the angular adjustment will be described below.

Figure 4:
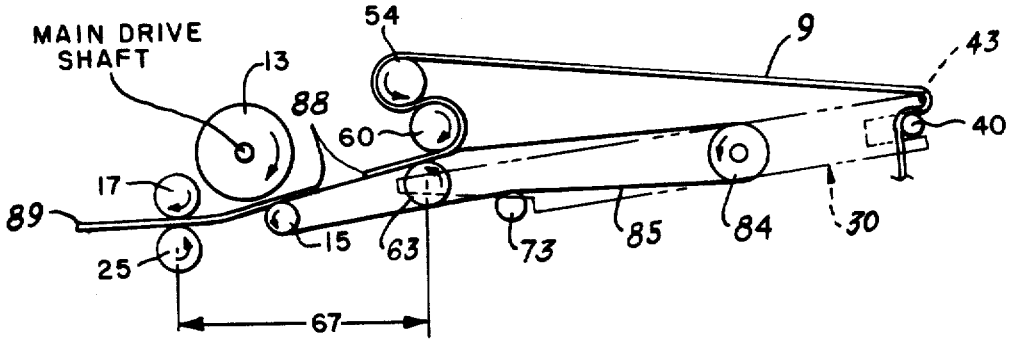
FIG. 4 is a schematic side view of the pulleys and drive wheels as they move a continuous form through the machine and burst it.

As the continuous form 9 is supplied to feeder tray 30 from a source (not shown), the continuous form 9 is threaded between lower surface 39 and over hanger bar 40 (FIG. 4). Hanger bar 40 is mounted in slots 41, 42 so that it can be adjusted along the longitudinal axis of feeder tray 30 to facilitate threading the continuous form between surface 39 and hanger bar 40.

The continuous form is wrapped over rounded edge 43 where the edges of the form engage the sides of guide bars 44, 45. Guide bars 44, 45 are mounted on upper surface 46 in spaced, parallel relationship. The distance between guide bars 44, 45 can be varied to correspond to the width of any standard continuous form. Guide bars 44, 45 can be magnetic bars which magnetically adhere to feeder tray 30, however, this embodiment is not intended as a limitation and guide bars 44, 45 may be adjustably mounted on upper surface 46 by any suitable means.

In accordance with one aspect of the invention, in FIG. 2 a pair of tension rollers are shown mounted on roller brackets 50, 51. The roller brackets 50, 51 are mounted for longitudinal movement along slots 52, 53 in feeder tray 30. A first tension roller 54 is removably mounted in roller brackets 50, 51, resting by its own weight at the bottom of slots 55, 56. First tension roller 54 has a coating 57 which is a rubber-like material capable of gripping the continuous form during operation. It should be understood that although a rubber-like coating 57 is desired, any material which has a suitable coefficient of friction with the continuous form is acceptable as a coating.

Mounted between first tension roller 54 and upper surface 46 is second tension roller 60. The second tension roller 60 is mounted in parallel relationship to roller 54, but it is slightly offset in the direction of rounded edge 43 so that it is not directly beneath roller 54 (see FIG. 4). Second tension roller 60 is rotatably mounted in roller brackets 50, 51. During operation first tension roller 54 lightly rests on second tension roller 60 with the continuous form sandwiched in between them. As the continuous form is wrapped over rounded edge 43 it travels above upper surface 46 and over first tension roller 54, between first tension roller 54 and second tension roller 60, and then under second tension roller 60 and onto the upper surface 46.

Feeder tray 30 has a longitudinal slot 61 extending from edge 62 along the longitudinal axis of tray 30 toward rounded edge 43. An idler pulley 63 projects into longitudinal slot 61 so that it is in slight contact with second tension roller 60. The idler pulley 63 is mounted slightly downstream of second tension roller 60, i.e., away from the rounded edge 43 of the feeder tray 30. Idler pulley 63 is mounted on shaft 64 so that it is freely rotatable. The shaft 64 is mounted so that it can slide along slot 65 of arm 66 (see FIG. 1). It is an important aspect of this invention that idler pulley 63 be adjustable in the longitudinal direction along slot 65. The distance between stripper wheels 17 and idler pulley 63 is determined by the distance between the perforations on a continuous form. The idler pulley is adjusted in the longitudinal direction along slot 65 to correspond to the desired distance based on the length between the perforations on the continuous form. The relationship between idler pulley 63 and the stripper wheels 17 is shown by distance 67 in FIG. 4, which corresponds to the distance between the perforations on the continuous form.

In addition to longitudinally adjusting idler pulley 63, the first tension roller 54 and the second tension roller 60 must also be adjusted in the longitudinal direction so that they continue to cooperate with the idler pulley 63. As mentioned above, roller brackets 50, 51 are adjustable along slots 52, 53 whereby the brackets carry the tension rollers along a longitudinal axis to correspond to the movement of idler pulley 63. If this adjustment is insufficient, the feeder tray 30 which carries the tension rollers 54 and 60 can be mounted in a different position along the longitudinal axis of machine 10 by slidably moving pins 31*a*, 32*a* along plates 33, 34 until the desired position is achieved. Each time idler pulley 63 is adjusted in the longitudinal direction, the angular relationship between feeder tray 30 and support channels 35, 36 must be adjusted by turning elevation screw 37. By controlling the angular relationship between the feeder tray 30 and the support channels 35, 36, the distance idler pulley 63 projects into longitudinal slot 61 can be controlled. This is necessary to maintain the cooperating relationship between the idler pulley 63 and first tension roller 54 and second tension roller 60.

When the continuous form exits the tension rollers it will be traveling at a high rate of speed and may have a tendency to fly up. To correct this condition, retaining plate 68 is mounted on bar 69 just upstream of the tension rollers. Retaining plate 68 can pivot on bar 69 and because of this one end of the plate lightly rests on upper surface 46. As the continuous form exits the tension rollers it slides between retaining plate 68 and upper surface 46 and is actually guided into the space between friction wheel 13 and idler wheel 15.

Figure 3:
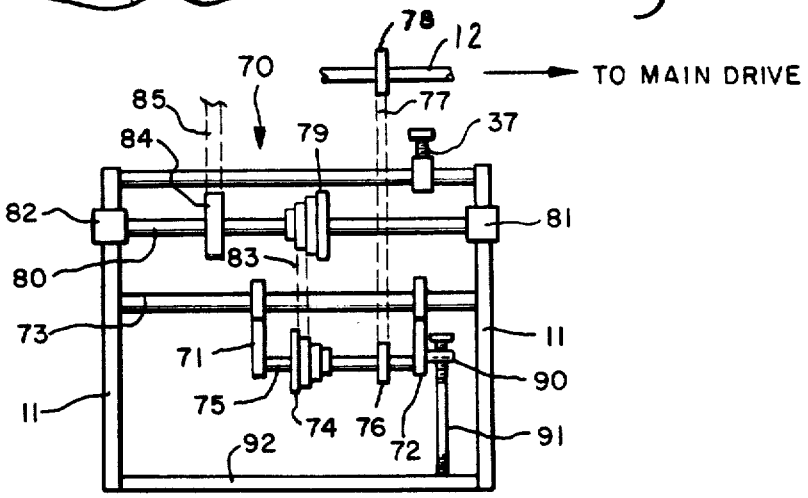
FIG. 3 is a schematic end view of the pulley drive mechanism.

The folding machine upon which feeder tray 30 is mounted will require several minor modifications in order to transmit power to idler pulley 63 so that the continuous form can be fed through the feeder tray. To accomplish this end, a pulley system 70, as shown in FIG. 3, is incorporated into one end of folding machine 10. It is noted that although a pulley system is utilized to pull the continuous form through the present invention, other means may be available which would adequately perform the operation. The advantage of using the folding machine's main drive system is to maintain the timing between main drive shaft 12 and pulley system 70, thus assuring that bursting occurs at the proper instant relative to other machine operations.

Turning to FIG. 3, a pair of brackets 71, 72 are mounted on cross member 73 which is securely fastened to frame 11. A first pulley train 74 is mounted on shaft 75 which is securely fixed on brackets 71, 72. First pulley train 74 is driven by drive pulley 76, which in turn is driven by a belt 77 running from drive pulley 76 to drive pulley 78 which is mounted on the main drive shaft 12.

A second pulley train 79 is mounted for rotational movement on shaft 80. A pair of pillow blocks 81, 82 are mounted on support channels 35, 36 and provide the mounting means for shaft 80 (see FIG. 2). Belt 83 transmits power from first pulley train 74 to second pulley train 79. In turn, second pulley train 79 transmits rotational drive to follower pulley 84.

A belt 85 transmits rotational drive from follower pulley 84 to both the idler pulley 63 and idler wheel 15, as shown in FIG. 2. It is noted that during operation belt 85 slightly projects through longitudinal slot 61 and contacts the continuous form in the area of the idler pulley 63 as the idler pulley 63 rotates, it in turn transmits rotational drive to second tension roller 60, which also in turn transmits rotational drive to first tension roller 54. This rotational action pulls the continuous form along feeder tray 30, through the tension rollers, and feeds it between frictional feed wheel 13 and idler wheel 15.

During operation belt 77 may have a tendency to become stretched or loose. To correct this, a belt tensioning device is utilized to compensate for belt stretching. A short knob 90 is securely fastened to bracket 72 and has a threaded hole running therethrough. A rod 91 is threaded through knob 90 and into cross bar 92 located on frame 11 near the floor of the machine. The threaded portion of rod 91 registers with the threaded portion of knob 90 so that as rod 91 is turned bracket 72 is free to pivot on cross member 73. Moving bracket 72 up or down creates the desired tension in belt 77 running between drive pulley 76 and drive pulley 78.

As can be easily seen, pulley system 70, especially first pulley train 74 and second pulley train 79 afford a wide range of driving speeds. The driving speed of pulley system 70 corresponds with the type of continuous form being run on the machine as well cooperating with the timing of stripper wheels 17 to assure bursting at the proper time. In other words, if the continuous form is of a heavy bond paper, it may be desirable to adjust the speed of the continuous form through the feeder tray at a higher rate of speed. In any event, the speed of the continuous form through the feeder tray will depend on such factors as the weight of the continuous form, the length and width, and the type of folding machine the feeder tray is mounted on.

As shown in FIG. 4, during the actual bursting operation a continuous sheet 9 is fed just above the upper surface 46 of the feeder tray 30, over the first tension roller 54, between the first and second tension rollers, and between the second tension roller 60 and the idler pulley 63. From the tension rollers the continuous form is fed between the friction feed wheel 13 and the idler wheel 15, keeping in mind that the continuous form is under a slight tension at all times. As the form leaves the friction feed wheel and the idler wheel, it is pulled between the stripper wheels 17 and the drive roller 25 whose linear tangential speed is approximately two and one-half times the linear tangential speed of the frictional feed wheel and idler wheel. The sudden increase in linear speed pulls the continuous form with such force that it burst apart at its perforation 88. The single form 89 is rapidly fed between the stripper wheels and drive roller for further processing in the folding machine. A new form, still connected to the continuous form, is introduced between the stripper wheels and drive roller so that the same process is repeated over and over.

The term "continuous form" as used herein refers to any type of a form that has perforations at periodic intervals along its length. A printer on a computer generally produces a continuous form of the type described herein. Also, the word "form" and the word "sheet" as used herein are meant to refer to the same type of material.

What is claimed is:

1. An apparatus for feeding a continuous form into a friction feed folding machine and subsequently bursting the form along periodic perforations, the folding machine having a frame with a main drive shaft mounted on the frame, a frictional feed wheel mounted on the main drive shaft, a pair of stripper wheels mounted on individual shafts, a means to rotate the stripper wheels including a drive roller, the stripper wheels rotating at some predetermined linear tangential speed which is faster than the linear tangential speed of the frictional feed wheel in order to burst the continuous form at its perforations, the improvement comprising, in combination:

a feeder tray;

means for mounting the feeder tray on one end of the folding machine;

means for aligning the continuous form when it engages the feeder tray;

a pair of tension rollers mounted on the feeder tray with the continuous form interwoven between the rollers;

a slot extending a distance along the longitudinal axis of the feeder tray;

an idler pulley adjustably mounted on the frame and protruding into the slot so it contacts one tension roller to transmit rotational movement to the roller;

means to transmit rotational movement to the idler pulley;

an idler wheel mounted in close relationship with the frictional feed wheel so that as the tension rollers pull the continuous form along the feeder tray surface from a source the continuous form is fed from the tension rollers and in between the frictional driving wheel and the idler wheel and is maintained in a tensioned condition until it reaches the stripper wheels whereupon the difference in linear tangential speed between the stripper wheels and the frictional drive wheel causes the form to burst along a perforation, the resulting single forms being transported along the folding machine for further processing.

2. An apparatus for feeding a continuous form into a friction feed folding machine and subsequently bursting the form along periodic perforations, the folding machine having a frame with a main drive shaft mounted on the frame, a frictional feed wheel mounted on the main drive shaft, a pair of stripper wheels mounted on individual shafts, a means to rotate the stripper wheels including a drive roller, the stripper wheels rotating at some predetermined linear tangential speed which is faster than that of the frictional feed wheel in order to burst the continuous form at its perforations, the improvement comprising, in combination:

a feeder tray;

means for mounting the feeder tray on one end of the folding machine;

means for aligning the continuous form when it first engages the feeder tray;

a first tension roller slidably mounted on the feeder tray and at right angles to the direction of flow;

a second tension roller slidably mounted on the feeder tray and in an off-set and cooperating relationship with the first tension roller, the continuous form being interwoven between the first and second tension rollers;

a slot extending a distance along the longitudinal axis of the feeder tray;

an idler puller adjustably mounted on the frame and protruding into the slot so its contacts one tension roller to transmit rotational movement to the roller;

means to transmit rotational movement to the idler pulley;

an idler wheel mounted on close relationship with the frictional feed wheel so that as the tension rollers pull the continuous form along the feeder tray surface from a source the continuous form is fed from the tension rollers and in between the frictional driving wheel and the idler wheel and is maintained in a tensioned condition until it reaches the stripper wheels whereupon the difference in linear tangential speed between the stripper wheels and the frictional drive wheel causes the form to burst along a perforation, the resulting single forms being transported along the folding machine for further processing.

3. The combination as claimed in claim 1 or claim 2, wherein the means for aligning the continuous form as it engages the feeder tray includes a pair of guide bars adjustably mounted in paralled spaced relation to each other on the surface of the feeder tray.

4. The combination as claimed in claim 1 or claim 2 further comprising a means for adjusting the height of the feeder tray relative to the folding machine.

5. The combination as claimed in claim 1 or claim 2, further comprising a sheet retainer mounted on the feeder tray for guiding the continuous form as it exits the tension rollers and before the sheet engages the friction feed wheel.

6. The combination as claimed in claim 1 or claim 2 wherein the idler pulley is adjustably mounted for longitudinal movement by mounting the pulley on a shaft which travels along slotted brackets so that as the shaft is moved in the slot, the distance between the idler pulley and the stripper wheels is varied to correspond to the distance between the perforations of the forms being run through the folding machine.

7. The combination as claimed in claim 1 or claim 2, wherein the means to transmit rotational movement to the idler pulley includes a plurality of pulleys mounted on a common shaft on the folding machine and being driven by the main drive shaft.

8. The combination as claimed in claim 7 further comprising a means to tighten the belts running from the pulleys including a tensioning rod for adjusting the tension in the belts by varying the distance between the pulleys.

* * * * *